United States Patent [19]

Pandell

[11] Patent Number: 4,642,868

[45] Date of Patent: Feb. 17, 1987

[54] METHOD FOR PUNCHING HOLES IN EDGE BINDING AND THE PRODUCT PRODUCED THEREBY

[75] Inventor: Nestor W. Pandell, Schenectady, N.Y.

[73] Assignee: Weathermate Marine Manufacturing, Inc., Salem, Mass.

[21] Appl. No.: 713,958

[22] Filed: Mar. 20, 1985

Related U.S. Application Data

[63] Continuation-in-part of Ser. No. 664,910, Oct. 26, 1984.

[51] Int. Cl.[4] ..... B21D 28/00

[52] U.S. Cl. ..... 29/429; 29/564.2; 52/3; 135/115; 160/380; 242/75.2; 408/1 R

[58] Field of Search ..... 52/3, 4; 114/103, 115; 160/380; 135/115 R; 242/75.2, 56.1; 408/58; 409/137; 428/45, 81, 99, 124, 131, 138, 192; 29/564.1, 564.2, 564.7, 429, 408

[56] References Cited

U.S. PATENT DOCUMENTS

| | | | |
|---|---|---|---|
| 1,451,610 | 4/1923 | Gestas | 408/58 |
| 3,540,674 | 11/1970 | Okamura | 242/75.2 X |
| 3,694,099 | 9/1972 | Nicholas | 408/58 |
| 3,904,145 | 9/1975 | Steinberger et al. | 242/75.2 |
| 3,987,592 | 10/1976 | Herminghaus et al. | 52/3 |
| 4,293,100 | 10/1981 | Sharlow | 242/75.2 X |

FOREIGN PATENT DOCUMENTS

| | | | |
|---|---|---|---|
| 2096029 | 10/1982 | United Kingdom | 408/58 |

*Primary Examiner*—Gil Weidenfeld
*Assistant Examiner*—Glenn L. Webb
*Attorney, Agent, or Firm*—Nolte, Nolte and Hunter

[57] ABSTRACT

Edge finished and edge binding for tarpaulins and the method and apparatus for finishing edges of tarpaulins in which the tarpaulin or separate edge binding material is made from a heavy duty fabric of the type woven of high density yarn and in which, at desired intervals along a center line, a series of holes is provided. The apparatus includes a rotating punch die and a slack bar for slackening the material to be punch/cut in advance of the punching/cutting operation. The mechanisms for advancing punch/cutting, slackening and taking up the processed material are timed.

8 Claims, 3 Drawing Figures

METHOD FOR PUNCHING HOLES IN EDGE BINDING AND THE PRODUCT PRODUCED THEREBY

This is a continuation-in-part of application Ser. No. 664,910, filed Oct. 26, 1984.

FIELD OF THE INVENTION

The novel edge binding produced by the method and apparatus of the invention comprises, generally, a strip having holes punched along the length of the strip with the centers of the holes spaced at a predetermined distance from each other. The binding is used to edge finish heavy duty tarpoulins and provide apertures along the edge for access to a tie-down rope or the like which has been sewn into the binding in accordance with the disclosures of co-pending application Ser. No. 664,910, filed Oct. 26, 1984.

Binding strips woven from heavy density polyethylene yarn are most suitable for this purpose. However, punching holes in this kind of binding strip with conventional punch die apparatus has proven unsuccessful largely because the die does not cut the heavy material completely or it renders the die cut holes ragged. The earliest suggested solution to this problem was to manually cut the holes or to manually trim them after punching, presuming that sufficient lengths of commercially usable punched and otherwise unmangled strips could be drawn from the punching apparatus.

THE INVENTION

The invention provides very strong edge binding strips having tie-down access holes along their lengths, woven from heavy density polyethylene yarn which may be coated on one or both sides with a spray coat of light density polyethylene or PVC or any other adhesive material which binds the yarn. It is also contemplated within the invention to provide tarpoulin edges with access holes along the edges thereof so that the edges may be folded along the hole centers and the outermost length of the edge sewn to the tarpoulin.

It is also contemplated within the invention to provide strong punched edge binding strips and tarpoulins with punched edges made from plastic materials other than polyethylene, particularly from woven heavy density thermoplastic yarns.

The method and apparatus of the invention includes a hollow tubular punch cutting die supported in a die mount for vertical punch and withdrawal movement and which is rotated during the punching operation. Rotation may be imparted by rotating the mount or the die and may be constant for simplicity. The die edge may be scalloped or linear, the former being preferred. Although the invention is applicable to processing a single strip of edge binding, a specific embodiment of the invention includes pulling off a plurality of overlying layers of edge binding strips from vertically spaced supply rolls positioned upstream of the die via a pull knob downstream of the die. The pull knob enters the vertically aligned, previously punch cut holes from beneath the layers of strips and draws the strips forwardly to position the next area of strips for punch cutting around the hole center, thereby spacing the centers of the punch cut holes from each other to a desired length.

Surprisingly, it has been found that if the layers of strips are allowed to remain taut under the influence of the pull knob and the drag from the supply rolls during the rotary cutting and punching operation, the holes will not be cut uniformly clean. Therefore, with the particular apparatus disclosed, the layers of binding are further drawn from the supply rolls via a vertically reciprocating bar which depresses the layers of binding just upstream of the die where they are permitted to hang slack, i.e., hand loose without strain, as the die operates on the area of the strips advanced to the rotary cutting and punching die.

When the holes are punch cut through the layers of strips, the pull knob is retracted below the path of the strips and returned to its initial position beneath the strips where it aligns with the then previously punch cut holes advanced from the die area by the previous forward movement of the pull knob.

The reciprocating movements of the pull knob, slack bar and die are timed from a control panel at which electrical connections to the servo mechanisms driving them are made.

The material punched cut from the layers of strips is drawn through the die by vacuum.

The finished layers of binding are then taken up on respective spindles in a conventional manner.

The preferred edge binding strip produced by the apparatus and method comprises a four (4) inch wide strip, woven from heavy density yarn, having holes of one and one-eighth ($1\frac{1}{8}$) inch diameters on six (6) inch centers, thus providing access to a tie-down element at a greater number of intervals along the length of a finished tarpoulin structure than prior art tarpoulin structures which are expensively finished with grommeted edge binding, for example.

THE DRAWINGS

DESCRIPTION

Figure 1:
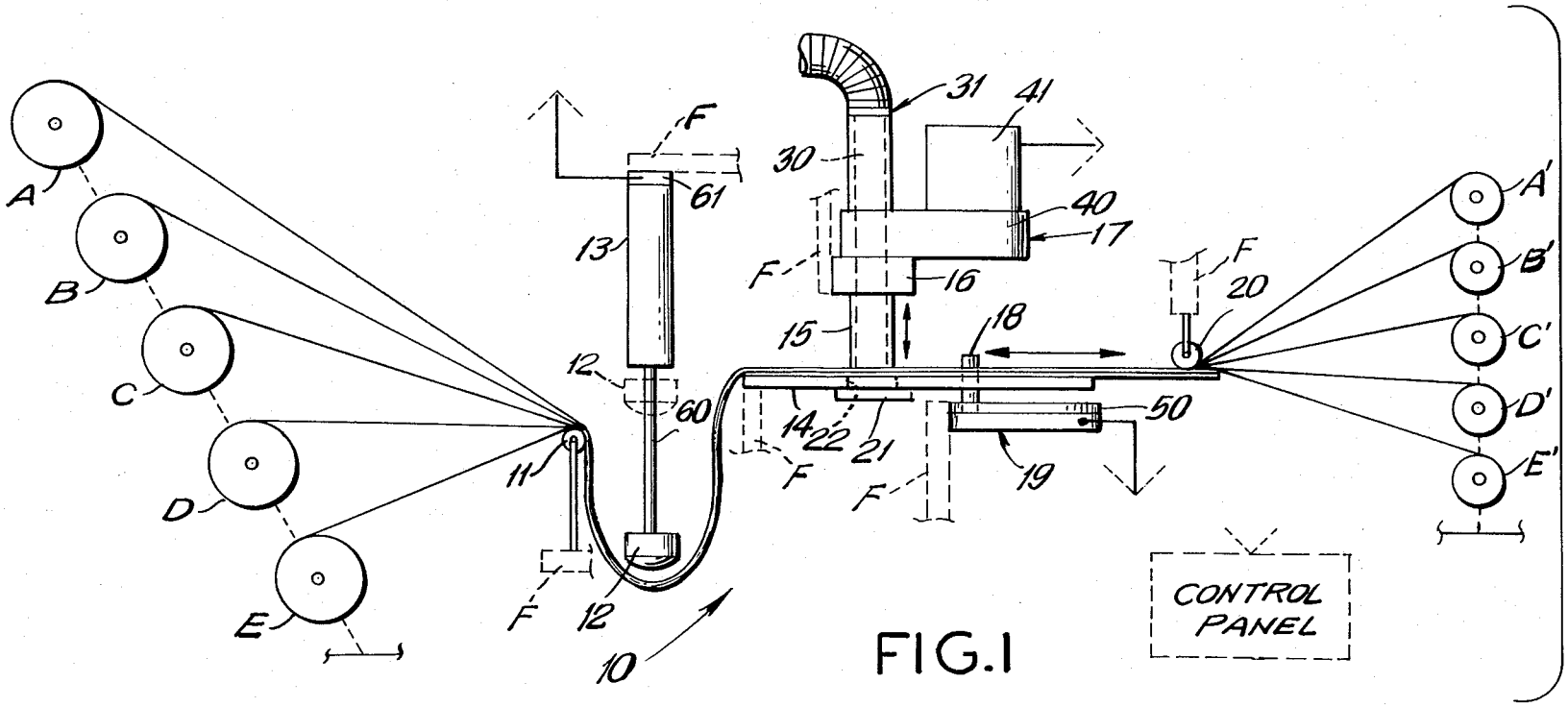
FIG. 1 is a schematic diagram of the machinery of the invention.

As seen in FIG. 1, the frame F of the edge binding strip die punch apparatus 10 supports a front guide 11, a vertically reciprocating slack bar 12 and its operating air cylinder 13, a work table 14, a round punch cutting due 15, the die mount 16 and drive 17, reciprocating and retracting pull knob 18 and its drive 19 and rear guide 20. A press plate 21 is supported on the table 14 below the round female opening 22 which receives the punch cutting die 15 and cooperates with it in punch cutting holes in each of the binding strips.

The punch cutting die 15 is hollow as depicted by the dash lines along the sides of the die in FIG. 1. Vertically adjacent passages 30 extending from the hollow punch cutting die 15 through the die mount 16 and drive 17, communicate with a vacuum tube 31 for withdrawing the material punch cut from the binding strips.

The punch cutting die is rotated and vertically reciprocated via gearing (not shown) in die mount 16 which is driven via belt drive 40 (or any convenient drive mechanism) of drive 17 which, in turn, is driven via motor 41 of drive 17.

Reciprocating pull knob 18 is mounted on a drive train 50 of conventional construction which moves the knob 18 downstream for drawing the binding strips, retracts the knob below the path of the binding strips, then moves the knob upstream to its initial position and then upwardly through the previously punched cut holes into the area of the binding material where it is driven again in the same manner. The drive train may be driven by its own motor or geared to motor 41.

Air cylinder 13, which reciprocates slack bar 12 via piston 60, is powered by air through valve 61 and is time controlled with the drives for knob 18 and die drive 17 via electrical connections, depicted as dotted arrows, through a control panel labeled as such in the figure.

Supply rolls A, B, C, D and E are supported upstream of the apparatus 10 in any conventional manner, for free rotation on their respective support shafts. In a similar manner, the downstream take up spindles A', B', C', D' and E' are conventionally supported on their respective shafts for winding the punch cut binding strips.

In accordance with the invention, five layers of edge binding strips, each four inches in width, for example, are plied over guide 11 as they are drawn from supply rolls A through E via reciprocating pull knob 18 moving to its downstream position. As the pull knob has been inserted into the previously punched cut hole in the plied layers, preferably about one and one-eighth inch in diameter, the movement of the knob to its downstream position will move the layers of the edge binding strips to position the next area of strips beneath the punch cutting die for punching around the hole center, thereby spacing the centers of the punch out holes preferably six inches apart.

When the layers of strips have been thusly positioned, slack bar 12 is caused to travel downwardly against the layers of strips in the area just before the work table and die 15. The pull knob 18 holds the strips stationary downstream of the die against the downward pressure of the slack bar upstream of the die, while the freely rotating supply rolls A through E supply a further length of plied strips over front guide 11. The slack bar is then retracted to it upper position (as shown by the dash lines in the figure), thereby leaving the length of strips upstream of the die in a slackened state, i.e., hanging loose without strain.

At this point, the die, which is constantly rotating in the embodiment being described, is reciprocated downwardly to punch cut holes in the plied strips at the punching station.

A vacuum is created in the hollow of the die 15 and vertically adjacent passageways 30 by conventional vacuum equipment to draw off the material that is punch cut by the die.

The pull knob 18 is then returned to its initial position via drive train 50 which retracts the knob beneath the layers of strips, brings it upstream and inserts the knob upwardly through the previously punch cut holes in the layers. The die is reciprocated upwardly then to permit the knob 18 to again travel downstream drawing the layers of edging from rollers A through E and the process is initiated again. As each punch cutting process is completed and pull knob 18 draws the edge binding from supply rolls A through E, take-up spindles A' through E' take up the individual layers of punch cut edge binding. These take-up spindles may be powered and timed for take up with pull knob 18, die drive 17 and slack bar 12.

Figure 2:
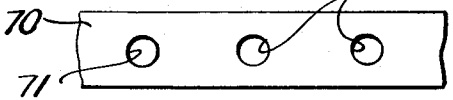
FIG. 2 is a plan view of a length of edge binding made in accordance with the invention.

The novel product of the method and apparatus of the invention is shown in FIG. 2. as a simple strip of edge binding 70 provided with holes 71 along the length thereof at predetermined and uniform centers. The edge binding 70 of FIG. 2 is shown in FIG. 3 folded along the center line of the punch cut holes 71 about both sides of the edge of a tarpoulin T and sewn to the edge of the tarpoulin T via stitching 72 which a tie-down rope 73 retained within the space formed by the folded edge strip of edge binding 70.

Figure 3:
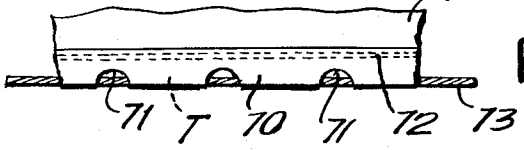
FIG. 3 is a plan view of a tarpoulin finished with the edge binding made in accordance with the invention.

As can be appreciated from the teachings herein, holes may be punch cut directly in the tarpoulin along a line parallel with the edge of the tarpoulin and the edge of the tarpoulin then folded along the center line of the holes and stitched to the tarpoulin body to present a finished edge, as shown in FIG. 3, without providing a separate edge binding. In this respect, the edge of a tarpoulin or the edges of plied layers of fabric may be processed in the same manner in which bindings are processed by extending the width of the apparatus to accommodate the width of the tarpoulin or plied layers of fabric.

The invention is to be restricted only by the following claims.

I claim:

1. A method of making a series of holes, equally spaced from one another along a common center line, through a heavy duty fabric of the type woven from high density yarn, comprising the steps of:

(a) providing, in seriatim, a supply roll of the fabric, a tubular punch cutting die and pulling means for drawing the fabric lengthwise from the supply roll;

(b) threading the fabric from the supply roll to beneath the punch cutting die and thence to the pulling means;

(c) securing, against lengthwise movement, the fabric which is in downstream adjacency to the punch cutting die;

(d) while the fabric is thus secured, successively providing a given slack to the fabric which is in upstream adjacency to the die and punch cutting one of said series of holes in the fabric by rotating and bearing the die upon and through the fabric;

(e) releasing, for lengthwise movement, the fabric which is in downstream adjacency to the punch cutting die;

(f) operating the pulling means to draw a length of fabric beneath the punch cutting die equal to the desired equal spacing of the series of holes to be made in the fabric; and (g) repeating steps (c) to (f) to provide for the making of additional ones of said series of holes in the fabric.

2. A method according to claim 1, wherein said given slack is provided by moving a vertically reciprocable bar a predetermined distance downwardly against the upper surface of the fabric so as to draw fabric from said supply roll and dispose it as a depending loop upstream of and adjacent to said punch cutting die, and by then moving said bar upwardly to leave said loop hanging free without strain.

3. A method according to claim 1, wherein the fabric downstream of the pulling means is taken up on a take-up roll operating in timed coordination with the drawing operation of the pulling means.

4. A method according to claim 1, wherein the punching from the punch cutting of each holes is ejected by vacuum from within the tubular punch cutting die.

5. A method according to claim 19, wherein the fabric is provided in the form of an edge binding strip, and said series of holes are made in said strip so that their common center line extends in parallel relationship with the longitudinal edges of said strip.

6. A method according to claim 1, wherein the fabric is provided in the form of a tarpaulin, and said series of holes are made in said tarpaulin proximate to at least one edge thereof and with their common center line extending in parallel relationship with said edge.

7. A method of making a series of holes, equally spaced from one another along a common center line, through a plurality of overlying layers of edge binding strips woven from high density yarn, comprising the steps of:

(a) drawing from a plurality of vertically spaced supply rolls a length of the layered strips beneath a tubular punch cutting die having a reciprocating punch and withdrawal movement;

(b) providing slack to the layered strips upstream of the die by drawing an additional length of the layered strips from said supply rolls while maintaining the layered strips stationary downstream of the punch cutting die;

(c) punch cutting a hole in the layered strips by bearing the die upon and through the layered strips beneath the die while rotating the die;

(d) releasing the layered strips for movement downstream of the die and moving the layered strips a distance downstream equal to the desired hole spacing; and (e) repeating steps (b) to (d) to provide for the making of additional ones of said series of holes in the layered strips.

8. A method according to claim 7, wherein the punching from the punch cutting of each hole is ejected by vacuum from within the tubular punch cutting die, and wherein each punched cut edge binding strip is taken up in timed coordination with the movement of the layered strips downstream of the die.

* * * * *